United States Patent [19]

Walse et al.

[11] Patent Number: 4,575,172

[45] Date of Patent: Mar. 11, 1986

[54] LOW INSERTION FORCE ELECTRICAL CONNECTOR WITH STRESS CONTROLLED CONTACTS

[75] Inventors: Alan Walse, LaGrange; John Stipanuk, Glen Ellyn, both of Ill.

[73] Assignee: Molex Incorporated, Lisle, Ill.

[21] Appl. No.: 727,714

[22] Filed: Apr. 26, 1985

Related U.S. Application Data

[63] Continuation of Ser. No. 597,333, Apr. 6, 1984.

[51] Int. Cl.[4] ..... H01R 13/62; H01R 13/50

[52] U.S. Cl. ..... 339/75 MP; 339/176 MP

[58] Field of Search ..... 339/17 L, 75 MP, 176 MP, 339/258 R, 258 F, 258 P, 17 LC

[56] References Cited

U.S. PATENT DOCUMENTS

| | | | |
|---|---|---|---|
| 3,701,071 | 10/1972 | Landman | 339/176 MP X |
| 3,713,079 | 1/1973 | Dechelette | 339/176 MP X |
| 3,795,888 | 3/1974 | Nardo et al. | 339/176 MP |
| 3,848,952 | 11/1974 | Tighe et al. | 339/125 R X |
| 3,920,303 | 11/1975 | Pittman et al. | 339/176 MP X |
| 4,084,874 | 4/1978 | Georgopolos | 339/75 MP |
| 4,128,289 | 12/1978 | Occhipinti | 339/176 MP X |
| 4,136,917 | 1/1979 | Then et al. | 339/176 MP X |
| 4,185,882 | 1/1980 | Johnson | 339/176 MP |

*Primary Examiner*—Gil Weidenfeld
*Assistant Examiner*—Steven C. Bishop
*Attorney, Agent, or Firm*—Louis A. Hecht

[57] ABSTRACT

A low insertion force multiple contact electrical connector with stress controlled connector spring contacts for use in making electrical contact with a plurality of conductive pads or strips formed along an insertable edge of a printed circuit board includes a plurality of smooth, continuously-curved connector spring contacts mounted in slots formed along an elongated cavity in a connector housing. Each spring contact includes a C-shaped portion with opposed, deflectable contacting portions for engaging the conductive strips disposed on opposite sides of the insertable edge of the printed circuit board. The opposed contacting portions define an opening through which the edge of the printed circuit board may be inserted in the cavity of the connector housing with low or zero insertion force. Subsequently, the printed circuit board is pivoted or rotated through an angle into a final contacting position, in which position the conductor strips on the printed circuit board engage and deflect the contacting portions of the spring contacts with a relatively high contact force. The C-shaped terminal portion is free to rock about a mounting leg integrally formed therewith. The connector housing includes first and second integrally formed stops or limit surfaces respectively associated with each of the opposed contacting portions of each spring contact that control or limit the deflection of the contacting portions and the resultant stress imparted to the spring contacts.

4 Claims, 3 Drawing Figures

LOW INSERTION FORCE ELECTRICAL CONNECTOR WITH STRESS CONTROLLED CONTACTS

RELATED APPLICATIONS

BACKGROUND OF THE INVENTION

This is a continuation of U.S. patent application Ser. No. 597,333 filed Apr. 6, 1984.

Field of the Invention

The device of the present invention generally relates to electrical connectors for making electrical connections to printed circuit boards and, more particularly, to low insertion force electrical connectors for making electrical connections to conductive strips mounted along the edges of printed circuit boards.

Brief Description of the Prior Art

Low insertion force electrical connectors for making electrical connections to conductive strips disposed generally in parallel along opposite sides of an elongated edge of a printed circuit board are old and well known in the prior art. Examples of such devices and electrical contacts for such devices are disclosed in U.S. Pat. Nos. 3,701,071; 3,795,888; 3,920,303; 3,848,952; 4,136,917 and U.S. Pat. No. Re. 26,692. The electrical connectors disclosed in such patents receive printed circuit boards with low insertion force in order to limit the wear of the spring contacts associated with the electrical connectors and the conductive strips associated with the printed circuit boards.

While many prior art electrical connectors have been able to provide low insertion force electrical connections with printed circuit boards, such devices typically do not provide fixed connector housing stops for directly contacting the printed circuit boards to limit the amount of contact force and resultant stress applied to the connector spring contacts. The possibility of overstressing the spring contacts thus exists which could result in a reduction of the effectiveness of the electrical connections between the spring contacts and the conductive strips on the printed circuit boards. A need exists for electrical connectors having housings that directly contact the printed circuit boards to limit the amount of deflection of the spring contacts mounted therein.

SUMMARY OF THE INVENTION

An object of the present invention is to provide a new and improved electrical connector.

Another object of the present invention is to provide a new and improved low insertion force electrical connector for use in making electrical connections to a printed circuit board.

Another object of the present invention is to provide a low insertion force electrical connector having a housing with an elongated cavity for the receipt of an insertable edge of a printed circuit board and having spring contacts mounted in the cavity for electrically contacting conductive strips disposed along an edge of the printed circuit board wherein the housing includes fixed limits or stops associated with each spring contact for directly physically contacting the printed circuit board to limit the deflection of the spring.

Briefly, the present invention relates to an electrical connector for a printed circuit board having a mating edge and first and second opposed surfaces with a plurality of contact pads on each surface adjacent said edge, said connector including an elongated dielectric housing with a cavity formed along its length for receiving the printed circuit board mating edge, a plurality of spring contacts mounted in the housing to engage the printed circuit board contact pads when the printed circuit board is inserted in the cavity at a first angular position and subseqently pivoted to a second angular position, the improvement wherein:

said spring contact being stamped and integrally formed to have a rounded continuously curved generally C-shaped portion with first and second free ends having contact surfaces disposed at different elevations in said cavity, and a leg mounted in the housing and extending from said C-shaped portion providing the sole support for said C-shaped portion when the printed circuit board is mounted therein, whereby said C-shaped portion is rockably mounted to have freedom of movement as said printed circuit board is pivoted in said cavity between said first and second angular positions; and said housing further includes first and second integrally formed limit surfaces disposed immediately adjacent said spring contact surfaces and said printed circuit board contact pads when said printed circuit board is inserted in said cavity, whereby said limit surfaces abut said printed circuit board surface to limit deflection of said C-shaped portion while maintaining the freedom of movement of said spring contact as said printed circuit board is pivoted in said cavity. In this manner, excess deflection of the contacting portions of the spring contacts is prevented.

BRIEF DESCRIPTION OF THE DRAWING

The above and other objects and advantages and novel features of the present invention will become apparent from the following detailed description of the preferred embodiment of the present invention illustrated in the accompanying drawing wherein.

DESCRIPTION OF THE PREFERRED EMBODIMENT

Figure 1:
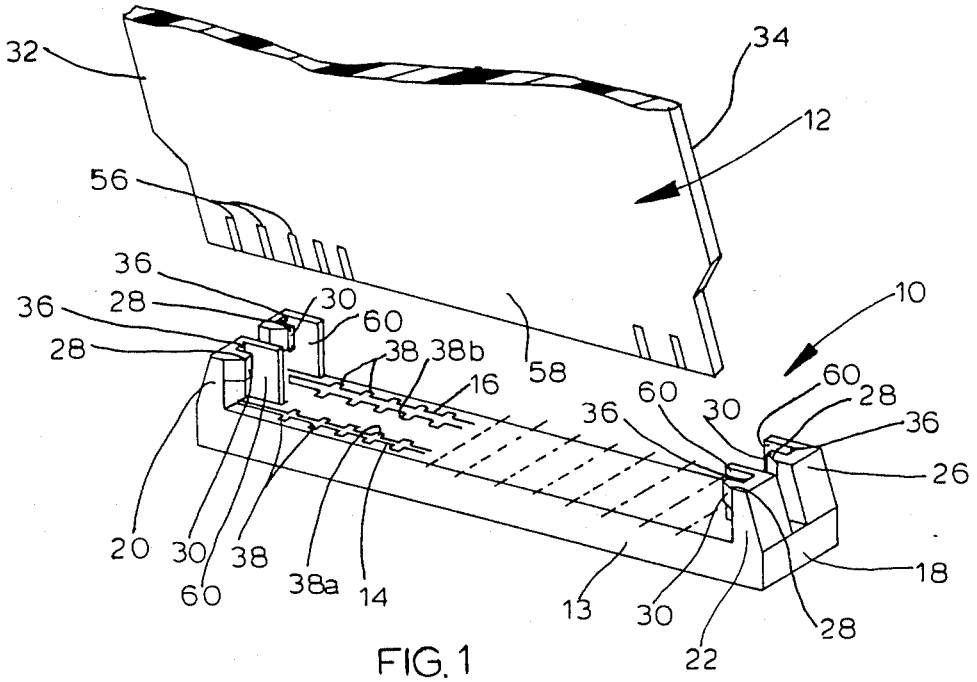
FIG. 1 is a perspective view of a printed circuit board and of an electrical connector for use therewith constructed in accordance with the principles of the present invention.

Referring to the drawing and initially to FIG. 1, there is illustrated a new and improved low insertion force multiple contact electrical connector 10, constructed in accordance with the principles of the present invention, for use in making electrical connections to a conventional printed circuit board 12. While the electrical connector 10 is depicted and described herein as being capable of receiving and making electrical connections to two printed circuit boards 12, the principles of the present invention disclosed herein are equally applicable to electrical connectors suitable for use in making electrical connections to a single printed circuit board or to a plurality of three or more printed circuit boards.

The electrical connector 10 includes an elongated housing 13, formed from any suitable insulating material, having a pair of elongated, spaced apart, access cavities 14 and 16 formed along an elongated base 18 and a plurality of four upstanding circuit board support or retention posts 20, 22, 24 and 26. Each of the posts 20–26 includes and integrally formed, resilient or yeildable latch 28 formed at the upper end thereof for yieldably retaining a printed circuit board in a final or contact position between associated pairs of the posts 20–22 and 24–26. More specifically, each latch 28 includes an elongated tapered surface 30 formed at its free end that is capable of being outwardly deflected upon contact with one of the spaced apart lateral edges 32 and 34 of the printed circuit board 12. When the printed circuit board 12 is fully received within a pair of spaced apart cavities 36, formed in the posts 20–26, the associated resilient latches 28 return to their nondeflected position (FIG. 1) to retain the printed circuit board 12 in its final or contact position.

Figure 2:
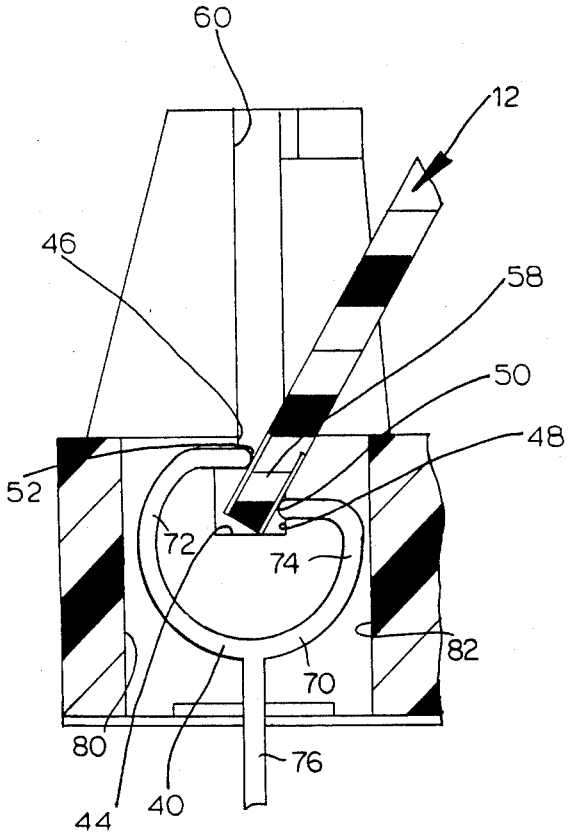
FIG. 2 is a fragmentary cross sectional view of the electrical connector of FIG. 1 taken along line 2—2 of FIG. 1 depicting the printed circuit board in its initial or inserted position in the electrical connector.
Figure 3:
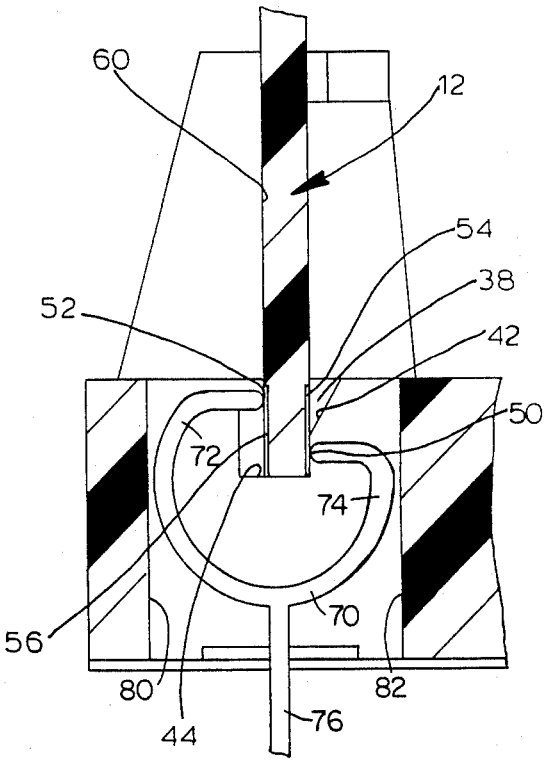
FIG. 3 is a fragmentary cross sectional view similar to the view of FIG. 2 depicting the printed circuit board in its final or contact position in the electrical connector.

Each access cavity 14 and 16 includes a plurality of generally parallel, spaced apart, transversely oriented slots 38 disposed along substantially its entire length. A connector spring contact 40 (FIGS. 2 and 3), stamped and integrally formed from any suitable resilient electrically conductive metallic material, such as a strip of beryllium copper having a thickness of approximately 0.015 inch, is disposed in each one of the slots 38. If desired, the spring contact 40 disposed in a slot 38 along the cavity 14 (for example, the slot 38A) may be electrically short circuited to the spring contact 40 disposed in a longitudinally aligned or otherwise associated slot 38 along the cavity 16 (for example, the slot 38B). This may achieved by forming the spaced apart spring contacts 40 in the slots 38A and 38B as integral portions of a single electrically conductive metallic strip. Alternatively, the spring contacts 40 in the access cavities 14 and 16 may be electrically insulated from each other. Each of the access cavities 14 and 16 also includes an elongated, inclined, insertion surface 42, a bottom surface 44, and inwardly protruding shoulder, stop or limit surface 46, and a vertically extending surface 48 disposed between the inclined surface 42 and the bottom surface 44.

Since the configuration and operation of the spring contacts 40 disposed in the slots 38 along the cavities 14 and 16 are essentially the same, only one such spring contact 40 is discussed in detail hereinafter. Each spring contact 40 has a rounded, continuously curved generally C-shaped portion 70 with two opposed arcuate beam members 72, 74 having free ends which comprise integrally formed, spaced apart, resilient contacting portions 50 and 52 for respectively contacting conductive pads or strips 54 and 56 disposed along opposite sides of an insertable edge 58 of the printed circuit board 12. A leg 76, mounted in the housing and extending from the C-shaped portion 70, provides the sole support for portion 70 when the printed circuit board 12 is mounted therein. By disposing the contacting portions 50 and 52 at different elevations within the slot 38 in the cavity 14 corresponding respectively to the elevational dispositions of the surface 48 and of the surface 46, the printed circuit board 12 may be inserted at an angle (FIG. 2) to its final or contact position (FIG. 3) in the cavity 14. The insertion angle or orientation of the printed circuit board 12 is generally parallel to the angle or orientation of the inclined surface 42. In this manner, low or zero insertion force is required to insert the edge 58 into the cavity 14, thereby minimizing undesirable wear on the conductive strips 54 and 56 and the spring contacts 40. The inclined surface 42 may be used as a guide surface for the insertion of the printed circuit board 12.

After its insertion, the printed circuit board 12 may be pivoted or rotated about the contacting portion 50 or the surface 48 until it assumes a final or contact position (FIG. 3) in which position the printed circuit board 12 rests against the bottom surface 44 and its lateral edges 32 and 34 are retained in the cavities 36 in the spaced apart posts 20 and 22. In this final or contact position, the contacting portions 50 and 52 are resiliently deflected outwardly from the center of the cavity 14 by their respective engagements with the conductive strips 54 and 56. The configuration of the spring 40 and of its contacting portions 50 and 52 is such as to provide a relatively high contact force between the contacting portions 50 and 52 and the conductive strips 54 and 56. The C-shaped portion 70 is pivotably or rockably mounted on leg 76 to maintain the high contact force despite any warpage or other misalignment of printed circuit board 12 and cavity 14. Any extraordinary increase in the pressure applied to one contacting portion causes C-shaped portion 70 to rock or pivot about leg 76, maintaining the equalized predetermined contact forces on both contacting portions 50, 52. Thus, each beam member 72, 74 must be free to move without contacting the walls 80, 82 of housing 13. However, as will be appreciated by those skilled in the art, means must be provided to prevent the overstressing of beam members 72, 74 beyond their intended limits.

In accordance with an important feature of the present invention, the deflection of the contacting portion 52, disposed at the same elevation and in an overlying relationship with the surface 46, and the resultant stress imparted to the spring contact 40 is limited by the stop or limit surface 46. That is, the contacting portion 52 cannot be deflected beyond the inwardly extending limit surface 46 since the limit surface 46 will physically engage the edge 58 of the printed circuit board 12 to limit its pivotable or rotational movement within the cavity 14. By aligning the vertically extending interior surfaces 60 (FIGS. 2 and 3) of each post 20–26 with the stop or limit surface 46, the pivotal or rotational movement of longitudinally extending portions of the lateral edges 32 and 34 disposed above the cavity 14 is also limited. The vertically extending surface 48 may also serve as a stop or limit surface to control or limit the amount of deflection of the contacting portion 50 of the spring contact 40 since the contacting portion 50 is similarly disposed generally at the same elevation and in an overlying relationship with the surface 48.

In this manner, a new and improved low insertion force electrical connector 10 is provided for making effective and reliable high contact force electrical connection with a printed circuit board 12 while reducing or preventing the possibility of overstressing the spring contacts 40 of the electrical connector 10.

Obviously, many modifications and variations of the present invention are possible in light of the above teachings. For example, rather than being formed as an uninterrupted surface, the stop or limit surface 46 (and, if desired, the surfaces 42 and/or 48) may be formed as a plurality of spaced apart stops or limit surfaces 46 associated with each slot 38 and each contacting portion 52. In addition, the precise configuration of the spring contacts 40 may be modified to achieve desired spring and contact characteristics. Thus, it is to be understood that, within the scope of the appended claims, the invention may be practised otherwise than as specifically described above.

We claim:

1. An electrical connector for a printed circuit board having a mating edge and first and second opposed surfaces with a plurality of contact pads on each surface adjacent said edge, said connector including an elongated dielectric housing with a cavity formed along its length with an opening for receiving the printed circuit board mating edge, a plurality of spring contacts mounted in the housing to engage the printed circuit board contact pads when the printed circuit board is inserted into the cavity through said opening at a first angular position and subsequently pivoted to a second angular position, the improvement wherein:

each of said plurality of contacts being stamped and integrally formed to have a rounded continuously curved generally C-shaped portion with first and second free ends each having a contact surface disposed at different elevations in said cavity, said ends being independently and resiliently moveable with respect to each other after both said contact surfaces engage the board, and a leg mounted in the housing and extending from said C-shaped portion intermediate the ends thereof providing the sole support for said C-shaped portion when the printed circuit board is mounted therein, whereby said C-shaped portion is rockably mounted to have freedom of movement as said printed circuit board is pivoted in said cavity between said first and second angular positions; and said housing further includes first and second integrally formed limit surfaces disposed immediately adjacent said contact surfaces and said printed circuit board contact pads when said printed circuit board is inserted into said cavity through said opening, whereby said limit surfaces abut said printed circuit board surface to limit deflection of said C-shaped portion while maintaining the freedom of movement of said spring contact as said printed circuit board is pivoted in said cavity.

2. An electrical connector as recited in claim 1 wherein said cavity includes an inclined surface diposed at an angle to said first limit surface, said inclined surface and said first limit surface being generally spaced apart across the opening of said cavity.

3. An electrical connector as recited in claim 1 wherein said housing further comprises means for retaining said printed circuit board in a contact position in which position said spring contacts electrically contact said edge of said printed circuit board.

4. An electrical connector as recited in claim 3 wherein said retaining means comprises a pair of spaced apart latches disposed above said cavity for retaining said printed circuit board in said contact position.

* * * * *